US007237845B2

(12) United States Patent
Mulmed

(10) Patent No.: US 7,237,845 B2
(45) Date of Patent: Jul. 3, 2007

(54) FURNITURE DESIGNED FOR SITTING AND HAVING INNER CORE SUPPORT ASSEMBLY

(75) Inventor: Theresa A. Mulmed, Scottsdale, AZ (US)

(73) Assignee: Dodaz, Inc., Scottsdale, AZ (US)

( * ) Notice: Subject to any disclaimer, the term of this patent is extended or adjusted under 35 U.S.C. 154(b) by 114 days.

(21) Appl. No.: 11/059,095

(22) Filed: Feb. 15, 2005

(65) Prior Publication Data

US 2006/0181135 A1 Aug. 17, 2006

(51) Int. Cl.

| | |
|---|---|
| ***A47C 7/28*** | (2006.01) |
| ***A47C 7/30*** | (2006.01) |
| ***A47C 7/34*** | (2006.01) |
| ***A47C 7/22*** | (2006.01) |
| ***A47C 7/02*** | (2006.01) |

(52) U.S. Cl. ..... 297/440.14; 297/440.1; 297/452.49; 297/452.52; 297/452.63; 297/452.64; 297/233

(58) Field of Classification Search ..... 297/440.1, 297/440.14, 452.44, 452.49, 452.5, 452.51, 297/452.52, 452.53, 452.54, 452.63, 452.64, 297/233

See application file for complete search history.

(56) References Cited

U.S. PATENT DOCUMENTS

| | | | | | |
|---|---|---|---|---|---|
| 995,277 | A | * | 6/1911 | Mueller | 297/452.63 X |
| 1,900,474 | A | * | 3/1933 | Wilson | 297/233 |
| 2,029,247 | A | * | 1/1936 | Mercogliano | 297/452.49 X |
| 3,001,822 | A | * | 9/1961 | Pagliaro et al. | 297/440.1 X |
| 3,030,146 | A | * | 4/1962 | Faxon | 297/440.1 X |
| 3,057,613 | A | * | 10/1962 | Benjamin | 297/452.63 X |
| 3,183,036 | A | * | 5/1965 | Hill | 297/440.1 X |
| 3,563,599 | A | * | 2/1971 | Heumann | 297/440.1 |
| 3,658,381 | A | * | 4/1972 | Grant, Sr. | 297/440.1 |
| 3,811,728 | A | * | 5/1974 | Redemske | 297/440.14 |
| 3,955,850 | A | | 5/1976 | Toso | |
| 4,034,429 | A | | 7/1977 | Smith | |
| 4,228,991 | A | | 10/1980 | Crosby | |
| 4,305,616 | A | * | 12/1981 | Martinez | 297/440.1 X |
| 4,364,547 | A | | 12/1982 | Crosby | |
| 4,480,823 | A | | 11/1984 | Marcinczyk | |
| 4,523,787 | A | * | 6/1985 | Robinson | 297/440.1 |
| 4,632,459 | A | * | 12/1986 | Herschlag | 297/440.1 |
| 4,636,006 | A | | 1/1987 | Kazaoka et al. | |
| 4,711,495 | A | * | 12/1987 | Magder | 297/452.52 |
| 4,848,839 | A | * | 7/1989 | Galardo | 297/440.1 |
| 5,016,305 | A | | 5/1991 | Suenens et al. | |
| 5,035,467 | A | | 7/1991 | Axelson et al. | |

(Continued)

*Primary Examiner*—Rodney B. White
(74) *Attorney, Agent, or Firm*—Robert D. Atkins; Quarles & Brady LLP

(57) ABSTRACT

An article of furniture has a sitting portion inner core assembly. The inner core assembly has a frame for providing structural support. Vertical bars connect lower and upper portions of the frame. Horizontal bars connect opposite sides of an upper portion of the frame. Alternative, the upper support structure of the frame uses box springs, free-floating horizontal bars with springs, or a mesh pattern for the structural support of the top portion of the inner core assembly. A cloth or foam pad covering is disposed along a side portion and top portion of the inner core assembly. A fabric material is disposed over at least the side and top coverings and inner core assembly. A back support inner core assembly with back support bars connect to the sitting portion inner core assembly and provide structure support of the back support portion of the furniture.

20 Claims, 6 Drawing Sheets

U.S. PATENT DOCUMENTS 5,232,266 A * 8/1993 Mork ..... 297/452.5
5,467,488 A 11/1995 Wagner
5,474,362 A 12/1995 Albecker, III
5,544,943 A * 8/1996 Durling ..... 297/452.63 X
5,601,340 A * 2/1997 Stout ..... 297/440.1 X
5,624,161 A 4/1997 Sorimachi et al.
5,832,551 A 11/1998 Wagner
6,017,093 A * 1/2000 Moser ..... 297/440.1 X
6,039,404 A * 3/2000 Fontana ..... 297/452.64
6,116,694 A * 9/2000 Bullard ..... 297/452.52
6,170,915 B1 * 1/2001 Weisz ..... 297/452.5
6,233,760 B1 5/2001 Cavazos
6,296,314 B1 * 10/2001 Klein ..... 297/440.14
6,367,880 B1 * 4/2002 Niederman et al. .... 297/440.14
6,715,837 B2 * 4/2004 Niederman et al. .... 297/440.14
6,826,791 B2 12/2004 Fromme
6,827,407 B2 12/2004 Niederman et al.
6,942,298 B2 * 9/2005 Harrison ..... 297/440.1
7,014,267 B1 * 3/2006 Nagar ..... 297/440.14
7,020,911 B2 * 4/2006 Oldham ..... 297/440.1 X
7,028,859 B2 * 4/2006 Moon et al. ..... 297/440.1 X

* cited by examiner

FURNITURE DESIGNED FOR SITTING AND HAVING INNER CORE SUPPORT ASSEMBLY

CROSS REFERENCE TO RELATED US PATENT APPLICATION(S)

The present patent application is related to copending U.S. patent application Ser. No. 11/059,211, filed Feb. 15, 2005, entitled "Composite Assembly of Interconnectable Furniture" and filed concurrently herewith by Theresa A. Mulmed. The present patent application is further related to copending U.S. patent application Ser. No. 11/059,162, filed Feb. 15, 2005, entitled "Furniture with Seating Space and Entertainment Center" and filed concurrently herewith by Theresa A. Mulmed.

FIELD OF THE INVENTION

The present invention relates in general to furniture designed and constructed for sitting purposes and, more particularly, to sitting furniture having an inner core support assembly.

BACKGROUND OF THE INVENTION

Furniture designed for sitting and lounging can be found in a myriad of usages and applications. Sitting furniture has uses in the home, business, and outdoor settings. In one example, outdoor furniture is placed on the patio, under the gazebo, and around the pool to create functional spaces for entertaining and relaxing.

Some types of outdoor furniture has a thick foam cushion or pad, e.g., 10–12 inches thick, and enclosed in a durable fabric. The extra thick cushion makes the furniture very comfortable for sitting purposes. The fabric has qualities of being sunlight resilient, water repellant, and washable. The thick fabric-enclosed cushion is often placed on a solid wooden or metal base.

Sitting furniture constructed as described above is generally satisfactory when the piece is relatively new. However, over time and usage, and in the presence of outdoor elements including extreme heat and cold, such furniture tends to fatigue and fail. The foam cushion breaks down and loses its ability to support weight. The fatigue problem is particularly true of larger and thicker cushions along the edges and corners. When a person sits on the older furniture, the cushion no longer provides the same level of support as it did when it was new. The cushion will lose its shape and depress beyond the point of comfort for the user. Ultimately, the sitting furniture will have to be repaired or replaced, typically long before the end of its intended service life. In some cases, the cushion-based outdoor furniture may have to be replaced after only one or two seasons of use.

A need exists for furniture designed and constructed for sitting, which maintains its shape and support features over time and usage, including in the presence of outside elements.

SUMMARY OF THE INVENTION

In one embodiment, the present invention is an article of furniture designed for sitting purposes, comprising a first inner core assembly. A side covering is disposed along a side portion of the first inner core assembly. A top covering is disposed over a top portion of the first inner core assembly. A fabric material is disposed over at least the side covering and the top covering.

In another embodiment, the present invention is an article of furniture, comprising an inner core assembly. A padded covering is disposed over a portion of the inner core assembly. A first fabric material is disposed over at least the padded covering and the inner core assembly.

In another embodiment, the present invention is an article of sitting furniture, comprising a first inner core assembly having a frame and upper support structure connected to the frame. A padded covering is disposed over a portion of the first inner core assembly. A first fabric material is disposed over at least the padded covering and the first inner core assembly.

In another embodiment, the present invention is a method of making an article of furniture, comprising providing a first inner core assembly, disposing a padded covering over a portion of the first inner core assembly, and disposing a first fabric material over at least the padded covering and the first inner core assembly.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
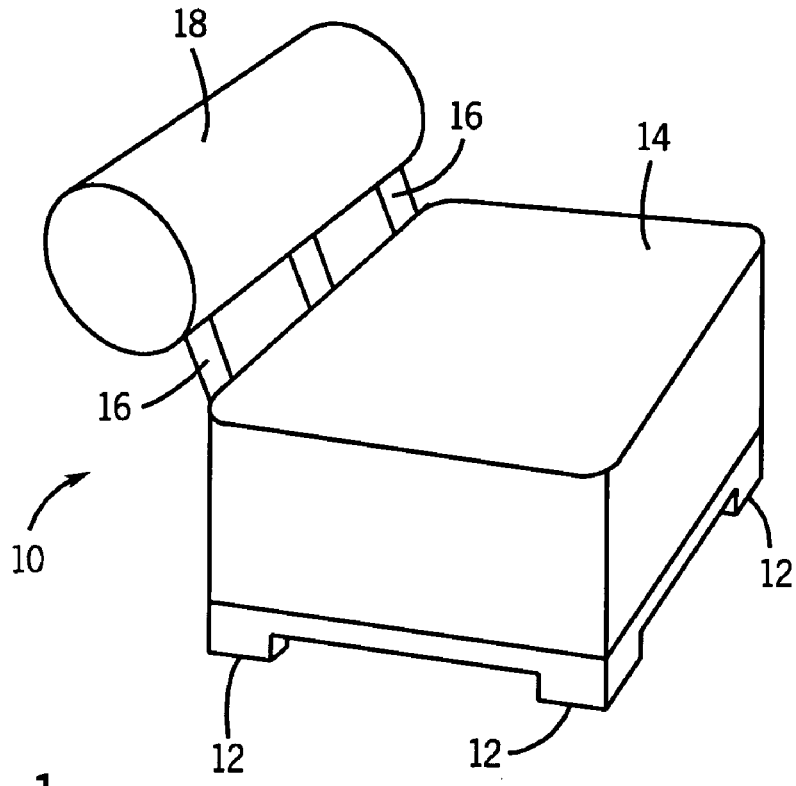
FIG. 1 illustrates an article of furniture with a back support designed for sitting.

Referring to FIG. 1, an article of furniture 10 is designed for sitting purposes and shown as suitable for supporting the weight of one or more adult persons. Furniture 10 is useful for many applications including home, office, industry, and outdoor spaces. Furniture 10 is durable, inexpensive, and may be used in settings such as office waiting rooms, employee break rooms, and family room in the home. Furniture 10 is ideal for outdoor uses such as on the patio, under the gazebo, and around the pool for relaxing and entertaining.

Sitting furniture 10 has legs 12 which are an integral component of a sitting portion inner core assembly (not shown in FIG. 1) as described more fully below. Sitting portion 14 is generally rectangular in shape, although circular, oval, and other regular and irregular shapes may be utilized. Sitting portion 14 includes cloth pads or cushions laid along and over the sides and top of the inner core assembly. In one embodiment, sitting portion 14 is 36 by 36 inches. A durable exterior fabric encloses at least the side and top pads and inner core assembly. The exterior fabric material is water proof, washable, and resistance to sun exposure and other outside elements.

As shown in FIG. 1, furniture 10 has back support bars 16 extending from the sitting portion inner core assembly to back support portion 18. The back support bars 16 are angled to provide lumbar support. The back support portion 18 also has a back support inner core assembly (not shown in FIG. 1) as described below. A cloth pad or cushion surrounds the back support inner core assembly. The back support portion 18 is cylindrical in shape, although it may be rectangular or take other forms and shapes.

Figure 2:
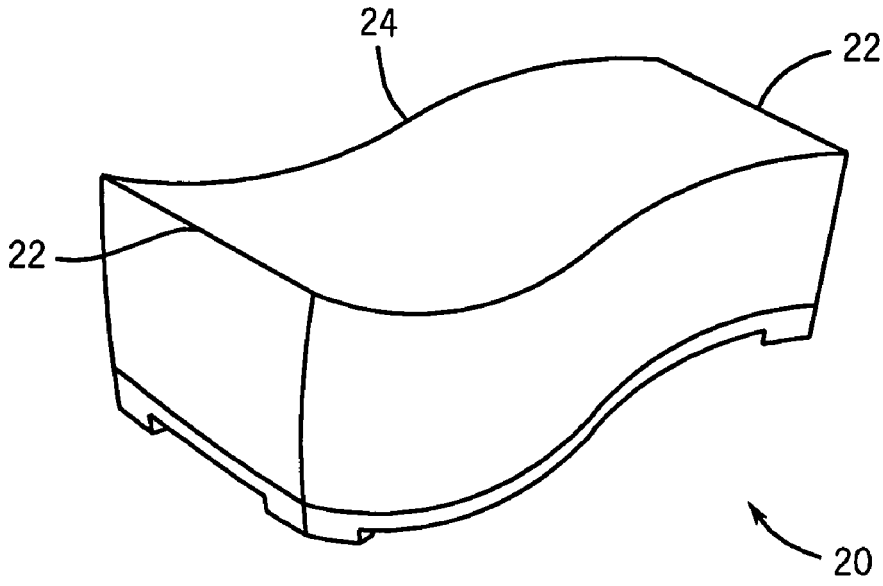
FIG. 2 illustrates an irregular shaped bench or multi-person seat.

Another embodiment of the sitting furniture is shown in FIG. 2. Sitting furniture 20 is shown as a bench or lounge and can provide seating space for multiple persons. In one embodiment, furniture 20 is 36 by 90 inches. Furniture 20 may include one or more back support portions (not shown) similar to FIG. 1 placed along one or both ends 22 or lengthwise side 24. The back support portion allows the user to recline or lounge on furniture 20. Furniture 20 has an irregular or contoured lengthwise side 24. Furniture 20 has a similar sitting portion inner core assembly and cloth pads or cushions laid along and over the sides and top of the sitting portion inner core assembly. A similar durable fabric encloses at least the side and top pads and inner core assembly of furniture 20.

Figure 3:
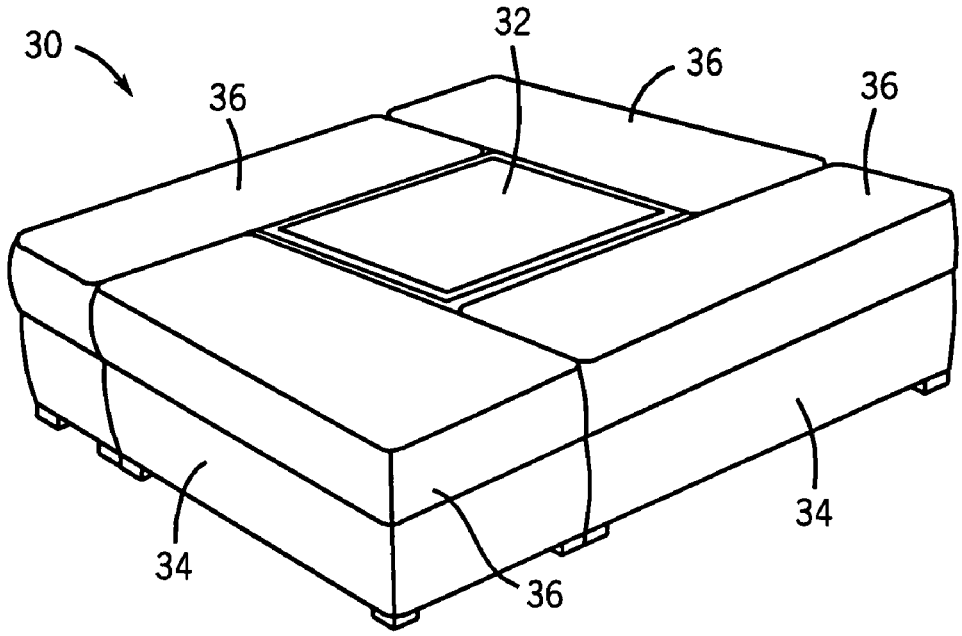
FIG. 3 illustrates sectional lounge with decorative center feature.

Yet another embodiment of the sitting furniture is shown in FIG. 3. Sitting furniture 30 is shown as a sectional surrounding decorative center feature 32. The seating area provides ample space for multiple persons. Decorative center feature 32 can be a table or box for holding or containing items such as plants, artwork, pictures, decorations, fountain, fire pit, rock garden, food and beverages, entertainment center, and the like.

Furniture 30 uses four lower assemblies 34 and four upper assemblies 36 surrounding decorative center feature 32. Each lower assembly 34 has a sitting portion inner core support assembly. One or more thin cloth pads are disposed along and over the sides and top of each lower assembly 34. The lower assembly 34 is then covered with a fabric material. There are four upper assemblies 36, each having an interior cushion which is covered with a fabric exterior. The upper cushion assemblies 36 are placed on the lower assemblies 34 and may be held in place with Velcro. In one embodiment, the upper cushion assemblies 36 are offset over adjacent lower assemblies 34. The upper cushion assemblies 36 are easily removable for cleaning and maintenance. Furniture 30 may include one or more back support portions (not shown) similar to FIG. 1.

Figure 4:
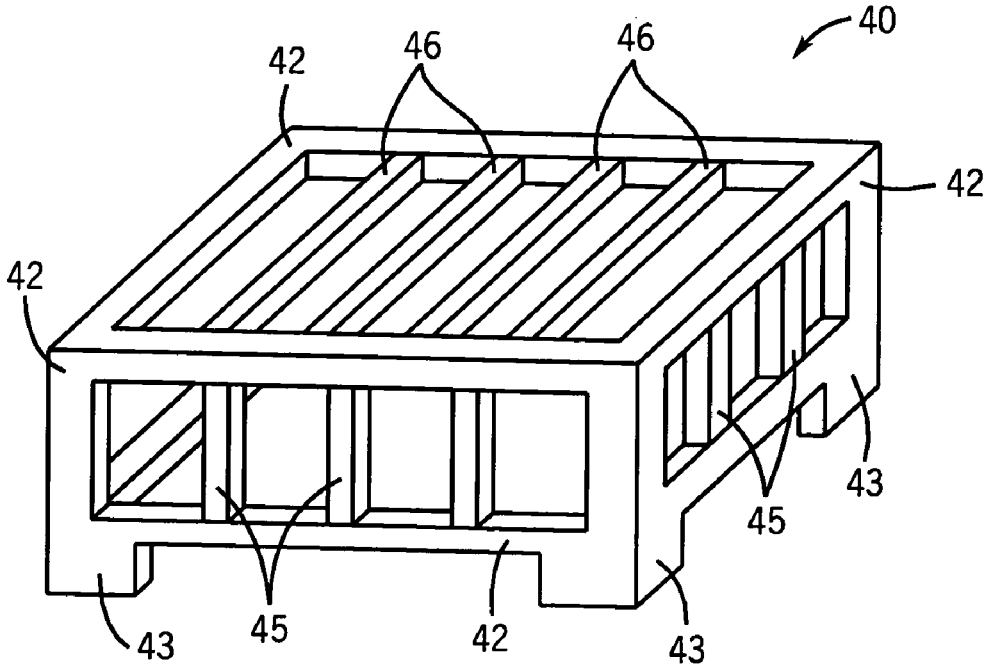
FIG. 4 is the inner core support assembly for the sitting furniture with horizontal bars.

One embodiment of the sitting portion inner core support assembly is shown in FIG. 4. The inner core assembly 40, or variation thereof as described below, may be used in sitting furniture 10, 20, and 30. The inner core assembly 40 has a box frame structure 42 made with interconnected bars as shown. Frame structure 42 has integral legs or base supports 43 designed to provide sturdy contact with the ground. A plurality of vertical bars 45 connect between upper and lower bar components of box frame 42 on each side of inner core assembly 40. A plurality of horizontal bars 46 connect opposite sides of the upper portion of box frame 42. The horizontal bars 46 may run either direction, diagonally, or criss-cross the upper portion of box frame 42.

In one aspect, the horizontal bars 46 provide a structural weight-bearing support across the horizontal upper portion of the inner core assembly 40. However, it is the combination of box frame 42 with vertical bars 45 and horizontal bars 46 that provide the composite structural weight-bearing support of the inner core assembly 40. The inner core assembly 40 can be made of metal, wood, polymer, or other weight-bearing material. The inner core assembly 40 is sufficiently rigid and sturdy to support the weight of one or more adult persons without noticeable bending or deformation. The structure of the inner core assembly 40 maintains its shape and rigidity beyond the useful service life of the sitting furniture.

Figure 5:
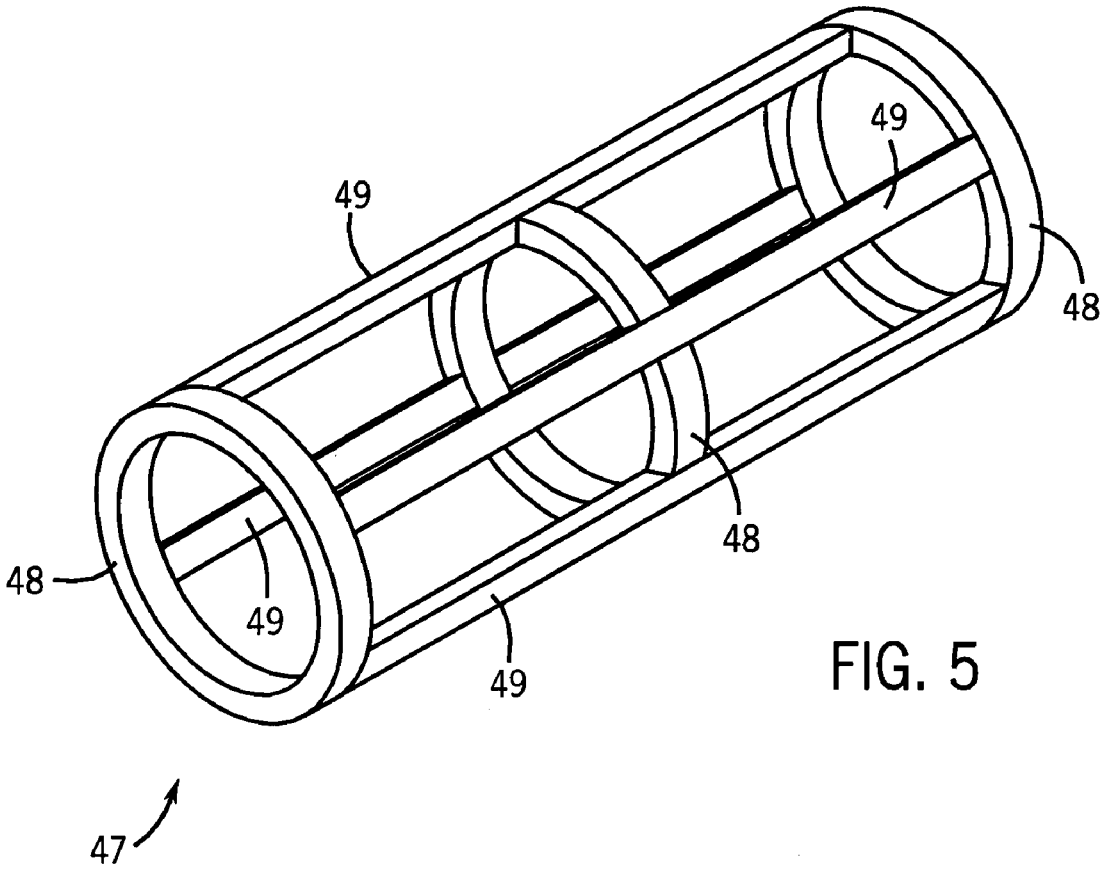
FIG. 5 is the inner core support assembly for the back support portion of the sitting furniture.

FIG. 5 illustrates the back support inner core assembly 47 forming the interior assembly of back support portion 18. The inner core assembly 47 is shown as being cylindrical in shape with circular end and center components 48 and connecting bars 49. The inner core assembly 47 can be made of metal, wood, polymer, or other weight-bearing material. Back support bars 16 connect between box frame 42 and inner core assembly 47. The structure of the inner core assembly 47 maintains its shape and rigidity beyond the useful service life of the sitting furniture.

Figure 6:
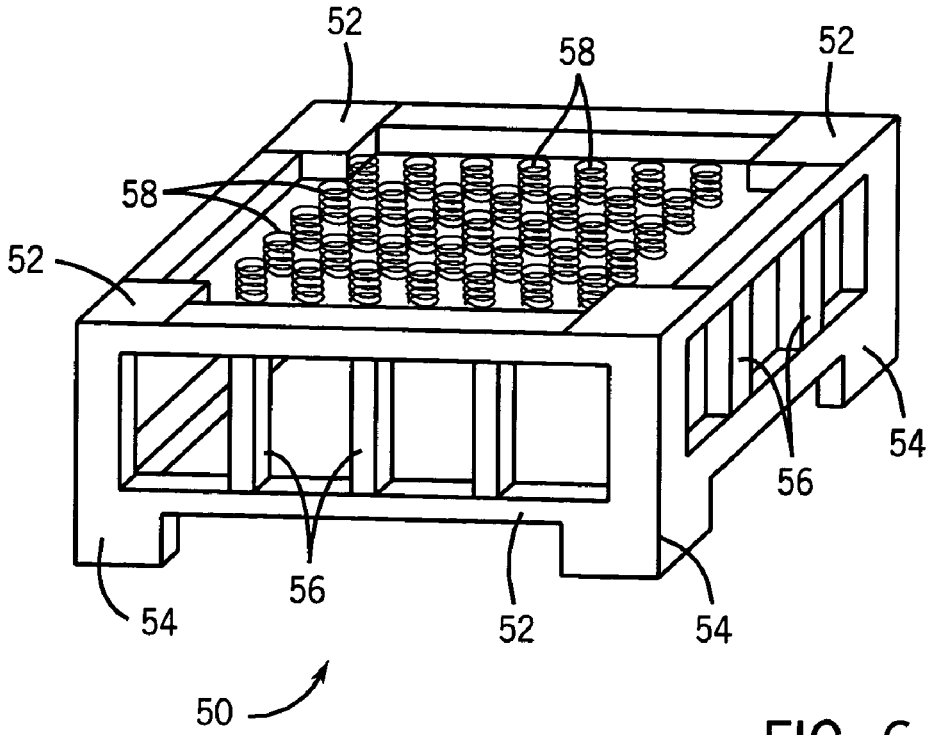
FIG. 6 is another embodiment of the inner core support assembly with supporting box springs.

Another embodiment of the sitting portion inner core assembly is shown in FIG. 6. The inner core assembly 50 has a box frame 52 with integral legs or base supports 54 similar to inner core assembly 40. A plurality of vertical bars 56 connect between upper and lower bar components of box frame 52 on each side of inner core assembly 50. A plurality of interconnected box springs 58 connect to the upper and lower portions of box frame 52.

The box springs 58 provide weight-bearing support for the horizontal upper portion of the inner core assembly 50. The combination of box frame 52, vertical bars 56, and springs 58 provide the composite structural weight-bearing support of the inner core assembly 50. As described for inner core assembly 40, back support bars 16 connect between box frame 52 and inner core assembly 47. The inner core assembly 50 can be made of metal, wood, polymer, or other weight-bearing material. The inner core assembly 50 is rigid to support the weight of one or more adult persons without noticeable bending or deformation. The structure of the inner core assembly 50 maintains its shape and rigidity beyond the useful service life of the sitting furniture.

Figure 7:
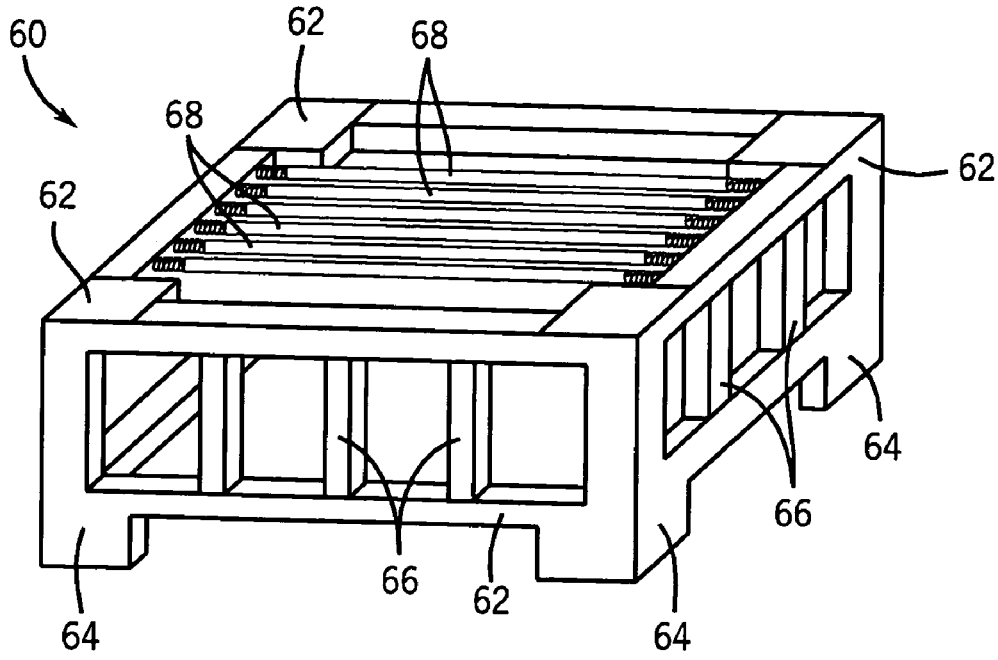
FIG. 7 is another embodiment of the inner core support assembly having free-floating bars with connecting springs attached to the inner core assembly.

Another embodiment of the inner core assembly is shown in FIG. 7. The inner core assembly 60 has a box frame 62 with integral legs or base supports 64 similar to inner core assembly 40. A plurality of vertical bars 66 connect between upper and lower bar components of box frame 62 on each side of the inner core assembly 60. A plurality of free-floating horizontal bars with connecting springs 68 mount to the upper bar components of box frame 62.

The free-floating bars with connecting springs 68 provide the weight-bearing support for the horizontal upper portion of the inner core assembly 60. The combination of box frame 62, vertical bars 66, and free-floating horizontal bars with connecting springs 68 provide the structural weight-bearing support of the inner core assembly 60. As described for inner core assembly 40, back support bars 16 connect between box frame 62 and inner core assembly 47. The inner core assembly 60 can be made of metal, wood, polymer, or other weight-bearing material. The inner core assembly 60 is rigid to support the weight of one or more adult persons without noticeable bending or deformation. The structure of the inner core assembly 60 maintains its shape and rigidity beyond the useful service life of the sitting furniture.

Figure 8:
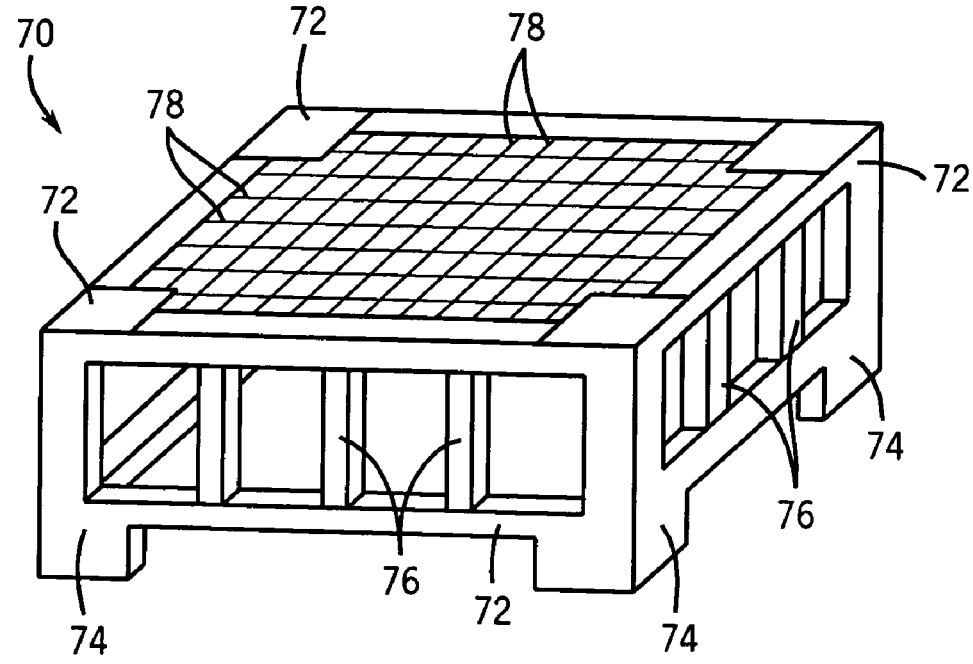
FIG. 8 is another embodiment of the inner core support assembly with supporting mesh pattern.

Yet another embodiment of the inner core assembly is shown in FIG. 8. The inner core assembly 70 has a box frame 72 with integral legs or base supports 74 similar to inner core assembly 40. A plurality of vertical bars 76 connect between upper and lower bar components of box frame 72 on each side of the inner core assembly 70. A mesh or weave support pattern 78 connects to multiple points on the upper bar components of box frame 72.

The mesh or weave pattern 78 provides weight-bearing support for the horizontal top portion of the inner core assembly 70. The combination of box frame 72, vertical bars 76, and mesh or weave 78 provide the structural support of the inner core assembly 70. The mesh or weave pattern 78 can be made with cloth material or plastic or metal straps. As described for inner core assembly 40, back support bars 16 connect between box frame 72 and inner core assembly 47. The inner core assembly 70 is rigid to support the weight of one or more adult persons without noticeable bending or deformation. The structure of the inner core assembly 70 maintains its shape and rigidity beyond the useful service life of the sitting furniture.

Figure 9:
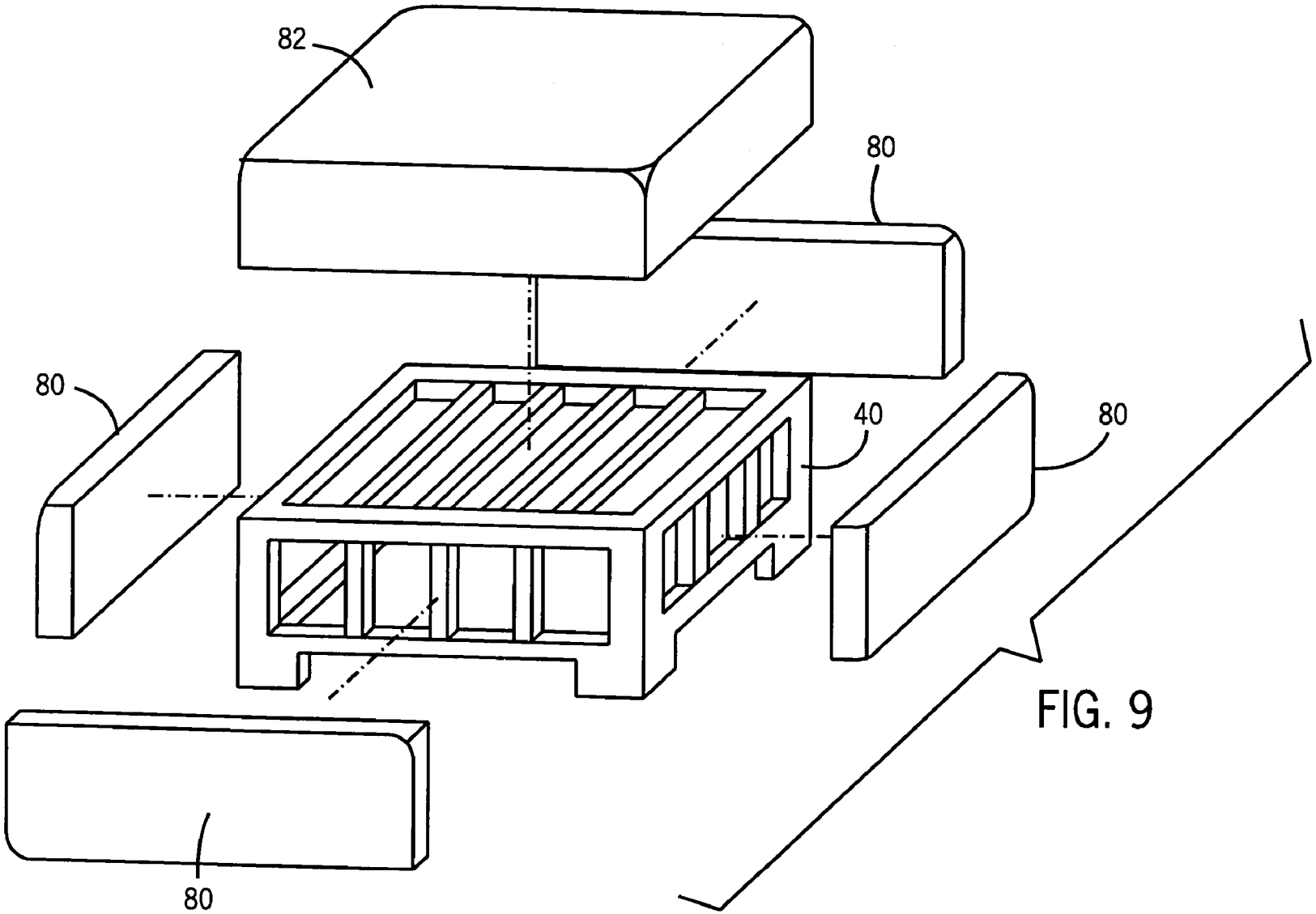
FIG. 9 illustrates the inner core support assembly with side and top pads.

The inner core assembly 40 is shown again in FIG. 9, although any one of the inner core assemblies described above could be used as well. The sides of inner core assembly 40 are covered with cloth pad or foam cushions 80. The cloth pad or foam cushion side coverings 80 may be 1–2 inches in thickness. A cloth pad or foam cushion top covering 82 is disposed over the horizontal top portion of the inner core assembly 40. In one embodiment, the cloth pad or foam cushion top covering 82 may be 5–6 inches in thickness. The top and side coverings are designed for comfort of the user.

In one embodiment, such as for sitting furniture 10 and 20, the structure of the sitting portion inner core assembly 40, side coverings 80, and top covering 82 are enclosed, at least on the sides and top, with a durable fabric material suitable for outside use. Likewise, the structure of the back support inner core assembly 47 and pad covering over the inner core assembly 47 are enclosed with a similar durable fabric material. Accordingly, the sitting portion inner core assembly and back support inner core assembly mentioned in FIG. 1 are illustrated and described in FIGS. 4–9. The exterior fabric provides a visually appealing and durable surface against outside elements. The exterior fabric also functions to hold the inner core assembly and cloth pads or foam cushions of the sitting portion and back support portion together as a tight assembly and single unit. The exterior fabric provides a protective covering which can withstand outside elements and be easily cleaned and maintained.

In another embodiment, such as for sitting furniture 30, the inner core assembly 40 and padded cloth side coverings 80 are enclosed within a first durable exterior fabric material. The cloth pad or foam cushion top covering 82 is covered with a second durable exterior fabric material. The first and second exterior fabric coverings provide a visually appealing surface and functions to hold together the inner core assembly and/or cloth pads or foam cushions, as well as provide protective covering for furniture against outside elements.

Figure 10:
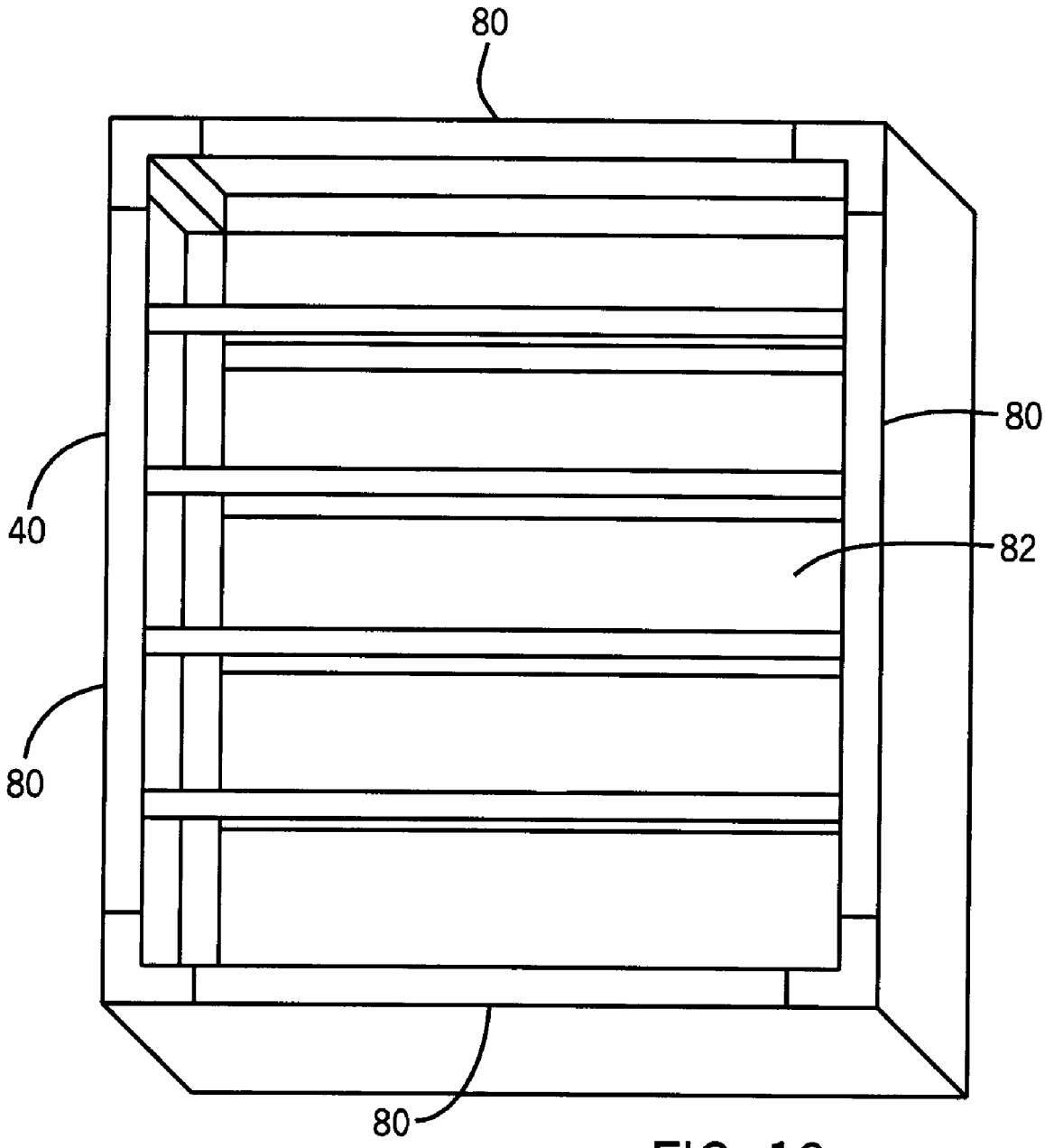
FIG. 10 is a bottom view of the sitting furniture with inner core support assembly and side and top pads.

FIG. 10 shows a bottom side view of sitting furniture 10. The bottom side of sitting furniture 10 may be open as shown or covered with thin fabric material. The side covering 80 are disposed on each of the four sides of the inner core assembly 40. The top covering 82 is shown disposed over the top area of the inner core assembly 40.

The inner core assembly described above provides significant advantages for sitting furniture, particularly of the type used in outdoor settings. The inner core assembly is rigid and maintains its shape over time and in the presence of the outside elements. The inner core assembly prevents the sitting cushions used in outdoor sitting furniture from sagging and permanently fatiguing as found in furniture using a thick cushion alone. The outdoor sitting furniture maintains its shape and support and provides years of usage without noticeable deformation.

While one or more embodiments of the present invention have been illustrated in detail, the skilled artisan will appreciate that modifications and adaptations to those embodiments may be made without departing from the scope of the present invention as set forth in the following claims.

What is claimed is:

1. An article of furniture designed for sitting purposes, comprising:

a first inner core assembly;

a side covering disposed along a side portion of the first inner core assembly;

a top covering disposed over a top portion of the first inner core assembly;

a fabric material disposed over at least the side covering and the top covering;

a second inner core assembly for providing back support, the second inner core assembly being cylindrical in form with a plurality of horizontal bars disposed between circular end members; and a back support bar connecting the first and second inner core assemblies.

2. The article of furniture of claim 1, wherein the first inner core assembly is formed as a single integral rigid frame for providing structural support of the first inner core assembly.

3. The article of furniture of claim 2, wherein the first inner core assembly further includes a plurality of vertical bars connecting a lower portion of the frame to an upper portion of the frame.

4. The article of furniture of claim 2, wherein the first inner core assembly further includes a plurality of horizontal bars connecting opposite sides of an upper portion of the frame.

5. The article of furniture of claim 2, wherein the first inner core assembly further includes a plurality of interconnected springs which are connected to the frame and support a top portion of the first inner core assembly.

6. The article of furniture of claim 2, wherein the first inner core assembly further includes a plurality of free-floating horizontal bars with connecting springs which are connected to an upper portion of the frame and support a top portion of the first inner core assembly.

7. The article of furniture of claim 2, wherein the first inner core assembly further includes a mesh pattern which is connected to an upper portion of the frame and support a top portion of the first inner core assembly.

8. An article of furniture, comprising:

a first inner core assembly;

a padded covering disposed over a portion of the first inner core assembly;

a first fabric material disposed over at least the padded covering and the first inner core assembly;

a second inner core assembly for providing back support, the second inner core assembly being cylindrical in form with a plurality of horizontal bars disposed between circular end members; and a back support bar connecting the first and second inner core assemblies.

9. The article of furniture of claim 8, wherein the padded covering is disposed over a top portion or a side portion of the first inner core assembly and enclosed within the first fabric material.

10. The article of furniture of claim 8, further including a cushion enclosed within a second fabric material, the cushion being adapted for disposing over a top portion of the first inner core assembly.

11. The article of furniture of claim 8, wherein the first inner core assembly is formed as a single integral rigid frame for providing structural support of the first inner core assembly.

12. The article of furniture of claim 11, wherein the first inner core assembly further includes a plurality of vertical bars connecting a lower portion of the frame to an upper portion of the frame.

13. The article of furniture of claim 11, wherein the first inner core assembly further includes a plurality of horizontal bars connecting opposite sides of an upper portion of the frame.

14. The article of fufriiture of claim 11, wherein the first inner core assembly further includes a plurality of interconnected springs which are connected to the frame and support a top portion of the inner core assembly.

15. The article of furniture of claim 11, wherein the first inner core assembly further includes a plurality of freefloating horizontal bars with connecting springs which are connected to an upper portion of the frame and support a top portion of the first inner core assembly.

16. The article of furniture of claim 11, wherein the first inner core assembly further includes a mesh pattern which is connected to an upper portion of the frame and support a top portion of the first inner core assembly.

17. An article of furniture, comprising:

a first inner core assembly having a frame the frame including a plurality of horizontal support members and a plurality of vertical support members disposed between the horizontal support members, wherein the frame is formed as a single integral rigid structure for supporting the first inner core assembly;

a padded covering disposed over a portion of the first inner core assembly;

a first fabric material disposed over at least the padded covering and the first inner core assembly;

a second inner core assembly for providing back support, the second inner core assembly being cylindrical in form with a plurality of horizontal bars disposed between circular end members; and a back support bar connecting the first and second inner core assemblies.

18. A method of making an article of furniture, comprising:

providing a first inner core assembly having a frame, the frame including a plurality of horizontal support members and a plurality of vertical support members disposed between the horizontal support members, wherein the frame is formed as a single integral rigid structure for supporting the first inner core assembly;

disposing a padded covering over a portion of the first inner core assembly;

disposing a first fabric material over at least the padded covering and the first inner core assembly;

providing a second inner core assembly for providing back support, the second inner core assembly being cylindrical in form with a plurality of horizontal bars disposed between circular end members; and connecting a back support bar between the first and second inner core assemblies.

19. An article of furniture, comprising:

a first inner core assembly having a frame, the frame including a plurality of horizontal support members and a plurality of vertical support members disposed between the horizontal support members, wherein the frame is formed as a single integral rigid structure for supporting the first inner core assembly;

a padded covering disposed over a portion of the first inner core assembly;

a first fabric material disposed over at least the padded covering and the first inner core assembly;

a second inner core assembly for providing back support, the second inner core assembly being cylindrical in form with a plurality of horizontal bars disposed between circular end members; and a back support bar connecting the first and second inner core assemblies.

20. The article of furniture of claim 19, wherein the second inner core assembly is formed as a single integral rigid structure.

* * * * *